US005647097A

United States Patent [19]

Kriegler et al.

[11] Patent Number: 5,647,097

[45] Date of Patent: Jul. 15, 1997

[54] PROCESS AND DEVICE TO SEVER THE FIBER SLIVER ON A TEXTILE MACHINE DELIVERING A FIBER SLIVER

[75] Inventors: Albert Kriegler, Rottenegg; Bernhard Mohr, Titting, both of Germany

[73] Assignee: Rieter Ingolstadt Spinnereimaschinenbau AG, Ingolstadt, Germany

[21] Appl. No.: 437,141

[22] Filed: May 5, 1995

[30] Foreign Application Priority Data

May 13, 1994 [DE] Germany ..... 44 16 947.7
May 13, 1994 [DE] Germany ..... 44 16 911.6

[51] Int. Cl.[6] ..... B65H 54/71

[52] U.S. Cl. ..... 19/159 A; 19/157

[58] Field of Search ..... 19/159 R, 106 R, 19/159 A, 157, 65 T, 65.3, 65.35, 65.37, 150; 57/90, 261, 22

[56] References Cited

U.S. PATENT DOCUMENTS

| | | |
|---|---|---|
| 3,083,416 | 4/1963 | Hashimoto . |
| 3,334,385 | 8/1967 | West et al. . |
| 3,354,513 | 11/1967 | Fornes . |
| 3,381,342 | 5/1968 | Selby et al. . |
| 3,613,175 | 10/1971 | Schumann et al. . |
| 4,109,357 | 8/1978 | Burow et al. . |
| 4,150,534 | 4/1979 | Raasch . |
| 4,497,087 | 2/1985 | Oehy . |
| 4,561,151 | 12/1985 | Schopwinkel . |
| 4,838,018 | 6/1989 | Hoeber . |
| 4,965,912 | 10/1990 | Kluttermann et al. . |
| 4,977,738 | 12/1990 | Stahlecker . |
| 5,113,550 | 5/1992 | Siegenthaler . |
| 5,208,946 | 5/1993 | Stentenbach . |

FOREIGN PATENT DOCUMENTS

| | | |
|---|---|---|
| 0493344A1 | 7/1992 | European Pat. Off. . |
| 0574659A1 | 3/1993 | European Pat. Off. . |
| 1217827 | 6/1966 | Germany . |
| 3609198A1 | 9/1987 | Germany . |
| 9014575.5 | 3/1991 | Germany . |
| 9108621.3 | 10/1991 | Germany . |
| 4028365A1 | 3/1992 | Germany . |
| 4123205A1 | 1/1993 | Germany . |
| 4308606A1 | 9/1994 | Germany . |
| 436051 | 11/1967 | Switzerland . |
| 672502 | 11/1989 | Switzerland . |
| 920046 | 3/1963 | United Kingdom . |
| 2039548 | 8/1980 | United Kingdom . |
| 2207445 | 2/1989 | United Kingdom . |

OTHER PUBLICATIONS

European Patent Office Search Report.

*Primary Examiner*—C. D. Crowder
*Assistant Examiner*—Larry D. Worrell, Jr.
*Attorney, Agent, or Firm*—Dority & Manning

[57] ABSTRACT

A process, and machine for carrying out the process, for severing a fiber sliver at a textile machine includes conveying the fiber sliver by a pair calendar rollers through a sliver guiding channel of a rotary plate into a sliver can disposed below the rotary plate. The calendar rollers are stopped, and thus also the conveyance of the sliver. A severing point is defined in the sliver downstream of the calendar rollers by drafting the fiber sliver with a moveable clamping device at a desired location of the severing point. Once the fiber has been drafted at the severing point, the sliver is severed by displacement of the can from below the rotary plate.

18 Claims, 5 Drawing Sheets

PROCESS AND DEVICE TO SEVER THE FIBER SLIVER ON A TEXTILE MACHINE DELIVERING A FIBER SLIVER

BACKGROUND OF THE INVENTION

The instant invention relates to a process and to a device to sever a fiber sliver on a textile machine delivering a fiber sliver. Such a textile machine could be a combing machine, a carder, or a draw frame. The textile machine delivering the fiber sliver deposits the delivered fiber sliver in cans. Severing of the fiber sliver is necessary when the can has reached its full state and must be replaced by an empty can.

The German application P 43 08 606.3 proposes that the fiber sliver be severed in the area between the pair of calendar rollers and the sliver guiding channel of a rotary plate. On this basis, a cutter is provided in that area. The described cutter is provided with a clamping device consisting of a grasper with controls and also of a severing device with a severing means, e.g. a circular knife, as an autonomously acting operating means. The clamping device and severing device may be mounted on a common presentation device.

The stopped fiber sliver is clasped in its direction of movement by means of the clamping device and is then severed by mechanical severing means of the severing device.

The cutter requires great constructive expenditure in its function, for a clamping device as well as for a severing device. Because of the reduced erection clearance between the pair of calendar rollers and the sliver guiding channel it is difficult to install and operate a clamping device as well as severing means.

It is also a disadvantage that the fiber sliver has nevertheless been deflected by the severing means from its direction of movement, so that the severed sliver was often positioned on or next to the edge of the sliver guiding channel. This causes difficulties when the textile machine is started up again. It has also been shown that the fibers were spread open at the cut edge of the severed sliver.

OBJECTS AND SUMMARY OF THE INVENTION

It is a principal object of the invention to avoid the disadvantage of the state of the art and to reduce the cost of a cutter significantly. Additional objects and advantages of the invention will be set forth in part in the following description, or may be obvious from the description, or may be learned through practice of the invention.

Severing of the fiber sliver becomes necessary when the can standing at a filling station is full and a can replacement is necessary. For positioning of the sliver end at the can edge or to obtain a constant sliver length, severing between the pair of calendar rollers and the sliver guiding channel has proven to be advantageous. In that process, the fiber sliver is guided by means of a pair of calendar rollers into the sliver guiding channel of a rotary plate and is deposited in a can.

The process requires that the conveying of the fiber sliver has stopped at the pair of calendar rollers on the textile machine delivering the fiber sliver. This means that operating elements such as the rotary plate, can floor, or traversing device of a can filling station are also stopped. The can which is in the filling position comes to a stop. The servering point of the fiber sliver should be located between the pair of calendar rollers and the opening of the sliver guiding channel.

The process according to the invention requires that the severing point to be created is drawn by means of a clamping device before severing the fiber sliver, so that a drawn segment is formed in the fiber sliver. The drawn segment represents a thin spot in the cross-section of the fiber sliver. This produced thin spot is severed by a subsequent severing process.

The drawn segment is formed by means of the clamping device in several steps. The clamping device advantageously clasps the fiber sliver at least at a distance beneath the nip of the pair of calendar rollers which is greater than the staple length of the fiber sliver. The clamping device which clasps the fiber sliver is subsequently displaced on a displacement path. The displacement may be at a right angle to the direction of fiber sliver movement. It may, however, also be oriented in the direction of the sliver guiding channel. Depending on the desired degree of drafting of the fiber at the severing point, the clamping device is taken correspondingly far on the displacement path. If strong drafting is desired, the clamping device is taken to a far position compared to a position for lesser drafting. This adjustability makes it also possible to take into account different materials of fiber sliver. These positions can be marked along the displacement path so that the displacement path can be adjusted for the clamping device. When the clamping device reaches the fixed position on the displacement path, the clamping device is opened. The clamping device should advantageously be brought back into its starting position without influencing the sliver. By means of the clamping device, the result is obtained that the severing point is drawn between the two clamping points, the pair of calendar rollers, and the clamping device. A drawing point is constituted at the severing point.

The drawing point produced is severed in a severing process which follows. This severing process may take place in that the full can which is standing in its stopped position is shifted. The shifting of the full can from the stopped position causes the deflected fiber sliver, including the drafted point, to be moved back in the conveying direction of the fiber sliver in a described embodiment of the displacement path, and to be severed at the precise drafting point as the can is displaced further. The can mushroom which is present between the lower machine table and the can presses the deposited fiber sliver so that the sliver end is pulled out of the sliver guiding channel and the severing process results in severing precisely at the drafting point.

In the process according to the invention the severed sliver beginning which hangs on the pair of calendar rollers is positioned precisely in the conveying direction relative to the sliver guiding channel. This facilitates restarting the textile machine, contrary to the known state of the art. A deposit of the sliver beginning on the edge of the sliver guiding channel is avoided. Furthermore, no spreading out of the severed fibers takes place.

Since merely a clamping device between the pair of calendar rollers and the sliver guiding channel is needed, there is no cramping of space as in the state of the art. The fact that the severing process can be realized by means of a displacement means for cans which is available on the textile machine proves to be cost-saving.

A turnstile for can replacement can be used as the displacement means for round cans. With flat cans, the existing traversing device and/or an additional conveying device for flat cans may be used as the displacement means.

In another variant of the process, the severing process at the drafting point can be carried out by means of a mechanical or pneumatic severing device if it is to be used. In that case shifting of the can for the purpose of severing is omitted.

In practice, fiber slivers of different materials and different staple length can be processed. This aspect is taken into account by the invention in an alternative, whereby the clamping device clasps the fiber sliver and moves it on a displacement path sufficiently far so that the fiber sliver is severed between the clamping device and the pair of calendar rollers. This is especially useful if very short staple lengths and a fine material, such as combed cotton for example, is used. With this material the danger that the fiber sliver is deflected too far and remains hanging on the edge of the sliver guiding channel after severing does not exist.

The severing device according to the invention is constituted by a clamping device for the fiber sliver and a displacement means for a can. The clamping device is installed next to the conveying path of the fiber sliver in the area of the pair of calendar rollers and sliver guiding channel. The clamping device is furthermore installed at the beginning of a shifting path and can be shifted and able to be fixed in position steps along the shifting path. The shifting path may extend advantageously at a right angle to the conveying direction of the fiber sliver, but in another embodiment the displacement path can also extend in the direction of the sliver guiding channel. The possibility of forming a drafting point in the fiber sliver by displacing the clamping device is determining for the positioning of the displacement path.

The clamping device has at least one clamping lever and a swivelling arm as operating means, each connected to an adjusting device. The adjusting device contains a controllable drive which is connected to a movable displacement mechanism, so that the clamping device can be shifted on the shifting path. To control the movements between the clamping device and the displacement means, both are connected to a control of the textile machine.

In one embodiment the clamping device may be made by mounting a swivel arm and an angled drive arm at their zenith in a rotary axle and mounting also a clamping lever at one end in the rotary axle, so that a scissor-like arrangement results between the swivel arm and the clamping lever. In rest position, the swivel arm and the clamping lever are across from each other, next to the conveying path of the fiber sliver. Furthermore, an adjusting device can be meshing with the drive arm via axle, so that the drive arm with the swivel arm can swivel in the rotary axle. The other adjusting device is engaged via axle into the clamping lever so that the clamping lever can swivel in the rotary axle. The position of clamping lever with stop can be adjusted by displacing and fixing a bolt in the oblong opening. In this manner it is possible to make an adjustment determining whether the stop can be positioned in proximity of the edge of the sliver guiding channel or more towards the center of the opening. The swivel arm can swivel at a right angle to conveying direction of the fiber sliver towards the stop and can be fixed. This represents clamping. The setting of the swivel arm, i.e. its stroke, can be adjusted via an arrangement of an axle in an oblong opening.

In order to carry out the process according to the invention, the swivel arm is moved by means of its adjusting device perpendicularly into the conveying direction of the fiber sliver, in the direction of the clamping lever. In this process, the fiber sliver is seized by the swivel arm and is bought to the stop of the clamping lever. The clamping lever may be positioned here at the edge of the sliver guiding channel 5 or next to the fiber sliver. The fiber sliver is clamped between the stop of the clamping lever and the swivel arm.

The swivel arm and the clamping lever can then be swivelled together by adjusting devices at a right angle to the conveying direction of the fiber sliver into an adjustable position of the displacement path. The fiber sliver is deflected from the conveying direction. Thereby, a drafting point can be produced at the future severing point or a severing point can be produced immediately. With this adjustment of the displacement path, it is possible to set the degree of drafting at the drafting point. Upon reaching the position step, the clamping device is opened and the swivel arm is brought back into its starting position. Following the severing process, the clamping lever is brought back into its starting position. The adjusting devices each are provided with a control connection to a control device of the textile machine. The control device controls the above-mentioned movements via the adjusting devices according to a control program and controls the displacement means at the required point in time.

Upon reaching a first position step on the displacement path, a drafting of the fiber sliver takes place between the two clamping points, the pair of calendar rollers and the clamping point of clamping lever and swivel arm. Thereby a drafting point is created by the clamping device at the subsequent severing point. During a subsequent can replacement, the full can must be pushed away beneath the rotary plate with its sliver guiding channel by means of a displacement means, so that the fiber sliver is severed at the drafting point.

The invention shall be described below through examples of embodiments.

DETAILED DESCRIPTION OF THE PREFERRED EMBODIMENTS

Figure 1:
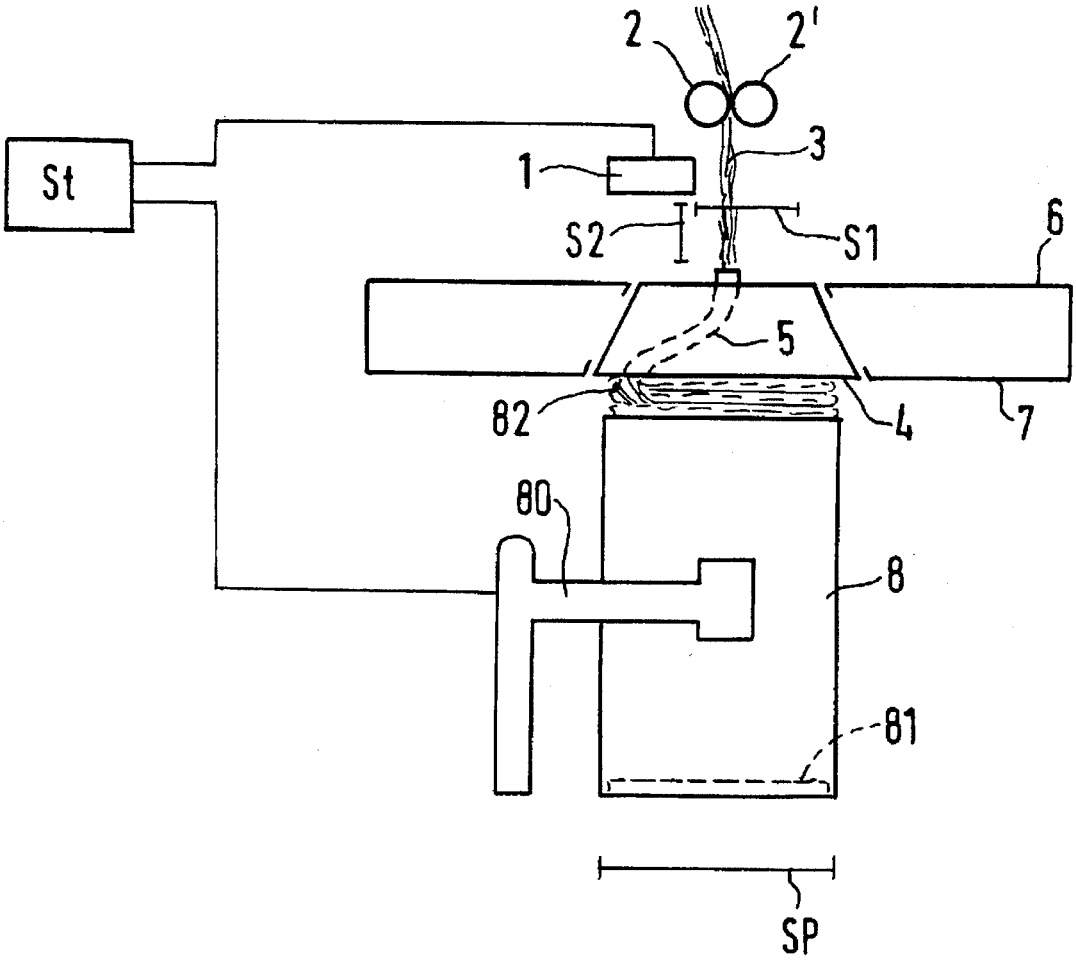
FIG. 1 shows an arrangement of the severing device consisting of clamping device and displacement means.

Reference will now be made in detail to the presently preferred embodiments of the invention, one or more examples of which are illustrated in the drawings. Each example is provided by way of explanation of the invention, and not meant as a limitation of the invention. In fact, various modifications and variations can be made in the present invention without departing from the scope and spirit of the invention.

FIG. 1 shows a detail of a textile machine delivering a fiber sliver. The area from a pair of calendar rollers 2, 2' to the deposit of the fiber sliver 3 into a can 8 is shown. In schematic representation, it is possible to recognize here a rotary plate 4 with its sliver guiding channel 5 which is rotatably mounted in a machine table. The machine table is characterized by an upper machine table 6 and a lower machine table 7. Combing machines, carders, and draw frames can be considered as textile machines which deliver a fiber sliver. The concept of fiber sliver includes hereinafter either a single fiber sliver, or a doubled fiber sliver consisting of several fiber slivers, or a fiber fleece. The can 8 stands beneath the lower machine table 7. The can 8 has a movable can bottom 81, which is pressed against the force of a spring to the bottom of the can as a result of the deposited fiber sliver. When the conveying of the fiber sliver is stopped at the pair of calendar rollers 2, 2', this also means that the rotation of the rotary plate 4 and the movement of the can are stopped by the can floor or the traversing device. In this situation, the can 8 is in its stopped position SP. A clamping device 1 is advantageously installed about one staple length of the fiber sliver to be processed below the pair of calendar rollers 2, 2'. The positioning may however be even lower. Furthermore, a displacement means 80 for a can 8 is shown schematically. The clamping device 1 and the displacement means 80 are connected to controls St.

The process requires that the conveying of the fiber sliver on the machine which delivers a fiber sliver is stopped at the pair of calendar rollers 2, 2'. This means that operating elements such as the rotary plate, can floor, or traversing device of a filling station for a can 8 are also stopped. The can 8 in the illustrated filling position comes to a stop. This position when stopped is the stopped position SP of the can 8. The severing point of the fiber sliver should be located between the pair of calendar rollers 2, 2' and the opening of the sliver guiding channel 5.

The process according to the invention requires that the severing point to be formed is drafted by means of a clamping device 1 before the severing of the fiber sliver, so that a drafting point is formed in the fiber sliver. The drafting point represents a thin spot in the cross-section of the fiber sliver. This produced drafting point is then severed by the severing process which follows.

The drafting point is formed by means of the clamping device 1 in several steps. The clamping device 1 advantageously clasps the fiber sliver at least at a distance below the nip of the pair of calendar rollers 2, 2' that is greater than the staple length of the fiber sliver. The clamping device 1 which clasps the fiber sliver is then displaced along a displacement path S1 or S2. The displacement path S1 may be at a right angle to the direction of fiber sliver conveying. However, it may also be in the direction of the sliver guiding channel (S2). Depending on the desired degree of fiber sliver drafting at the severing point, the clamping device 1 is moved more or less far along the displacement path S1, S2. If strong drafting is desired, the clamping device 1 is taken into a farther position than the position for lesser drafting. With this adjustability, it is also possible to take different materials of fiber sliver into consideration. These positions can be marked on the displacement path S1, S2, so that the displacement path of the clamping device 1 can be adjusted. When the clamping device 1 reaches the position fixed on the displacement path, the clamping device 1 is opened. The clamping device should advantageously be returned to its starting position without influencing the sliver. By means of the clamping device 1, the result achieved is that the severing point is drafted at the severing point between the two clamping points, the pair of calendar rollers and the clamping device. A drafting point is formed at the severing point.

The drafting point produced is severed by a severing process which follows. This severing process may be carried out by displacing the full can 8 which is standing in its stopped position (by means of displacement means 80). By shifting the full can from its stopped position according to a described embodiment of the displacement path, the fiber sliver deflected between the pair of calendar rollers 2, 2' and the sliver guiding channel 5, including the drafting point, is brought back in the conveying direction of the fiber sliver and is severed precisely at the drafting point as the can 8 is displaced further. The can mushroom 82 provided between the lower machine table 7 and the can 8 presses the deposited fiber sliver so that the sliver end is pulled out of the sliver guiding channel 5 and the severing process effects the severing precisely at the drafting point. By displacing the can by means of the displacement means 80 up to an end position of the can replacement system, the sliver end is pulled out of the sliver guiding channel 5 and hangs down at the can edge. The result is obtained that the length of the sliver end always has the same length on can 8.

Figure 2:
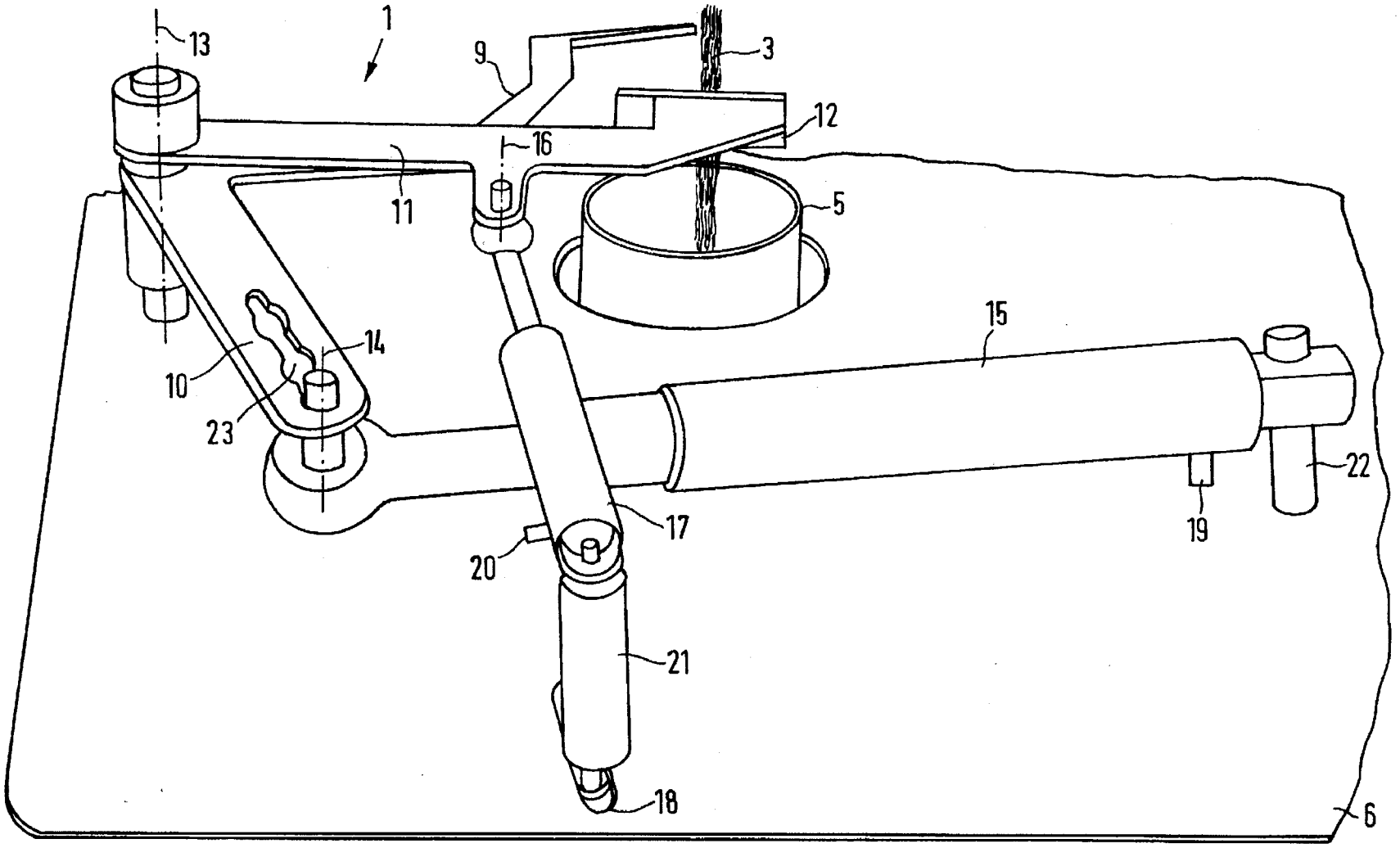
FIG. 2 shows an embodiment of a clamping device.

FIG. 2 shows the essential operating means of the clamping device 1. The operating means are installed on the upper machine table 6. The inlet opening of the sliver guiding channel 5 can be recognized. In a plane above the sliver guiding channel, on either side next to the sliver guiding channel, representing essential operating means, a swivel arm 9 with a drive arm 10 attached at an angle and a clamping lever 11 with stop 12 are provided. The swivel arm 9 and the drive arm 10 are mounted at their zenith in the rotary axle 13. Both operating means, the swivel arm 9 and the clamping lever 11 are arranged in scissor form in relation to each other.

The drive arm 10 is engaged via axle 14 with an adjusting device 15. The adjusting device 15 is able to move the drive arm 10 and thereby the swivel arm 9 via the engagement of axle 14 with the drive arm 10. The drive arm 10 is provided with an oblong opening 23, so that the axle 14 can be adjusted in the longitudinal direction. The stroke of the swivel arm 9 is thus adjustable. The adjusting device 15 may be a pneumatic cylinder with movable piston rod, whose piston rod can be controlled for thrust or pull. The piston rod can be extended so that the swivel arm 9 can be moved towards stop 12. The control of the adjusting device 15 is possible via control connection 19 which is connected to controls St.

The clamping lever 11 is engaged via axle 16 with an adjusting device 17 which is mounted on a bolt 21. By displacing the bolt 21 in the oblong opening 18 it is possible to make the basic position of the clamping lever 11 adjustable and fixable. By controlling the adjusting device 17 by means of controls St, it is possible to withdraw the piston rod into the adjusting device 17 so that the clamping lever 11 can be moved from its basic position next to the sliver guiding channel 5 into an adjustable position. The adjusting device 17 is provided with a control connection 20 for control.

In order to carry out the process according to the invention, the swivel arm 9 is moved by means of its adjusting device 15 at a right angle to the conveying direction of the fiber sliver in the direction of clamping lever 11 according to the shown, advantageous embodiment. The clamping lever 11 may in this case be positioned at the edge of the sliver guiding channel 5 or next to the fiber sliver. The fiber sliver is clamped between the stop 12 of the clamping lever 11 and the swivel arm 9. The two operating means form a clamping point KS of the fiber sliver.

The swivel arm 9 and the clamping lever 11 can then be swivelled together by the adjusting device 15 and the adjusting device 17 at a right angle to the direction of fiber sliver conveying and into an adjustable position of the displacement path S1. The fiber sliver is deflected from the conveying direction. Thereby a drafting point can be produced at the future severing point or a severing point can be produced immediately. If a drafting point is produced, a severing process is initiated in that the can 8 is displaced from its stopped position SP by means of the displacement means 80. The movement of the can pulls the fiber sliver, as ensured by the can mushroom 82. The sliver breaks at the drafting point. The displacement of the can continues until the sliver end is pulled out of the sliver guiding channel of the rotary plate and hangs down at the can edge. With adjustment of the displacement path, it is possible to determine the degree of drafting at the drafting point. Upon reaching the position step, the clamping device is opened and the swivel arm 9 is brought back into its starting position. Following the severing process, the clamping lever 11 is brought back into its starting position. Each of the adjusting devices 15, 17 has a control connection 19, 20 for a control device of the textile. machine. The control device controls the above-mentioned movement via the adjusting devices 15 and 17 in accordance with a control program and controls the displacement means at the proper point in time.

Figure 3:
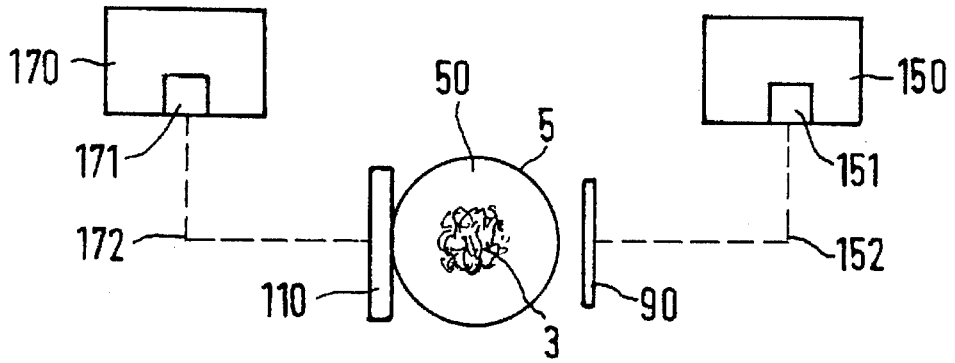
FIG. 3 schematically shows the starting positions of the operating means of the clamping device (top view of the sliver guiding channel)
Figure 3A:
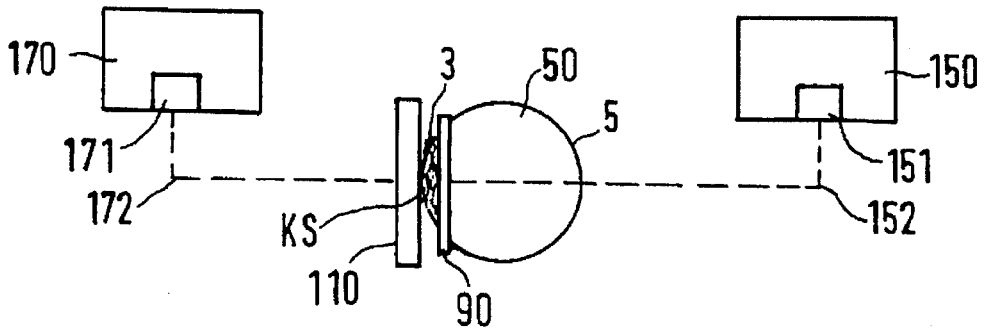
FIG. 3*a* shows the formation of a clamping point.
Figure 3B:
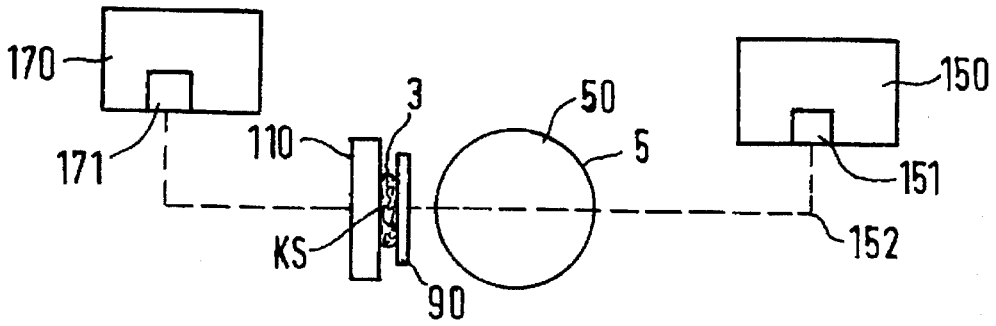
FIG. 3*b* shows the shifting of the clamping point and the formation of a drafting point.
Figure 3C:
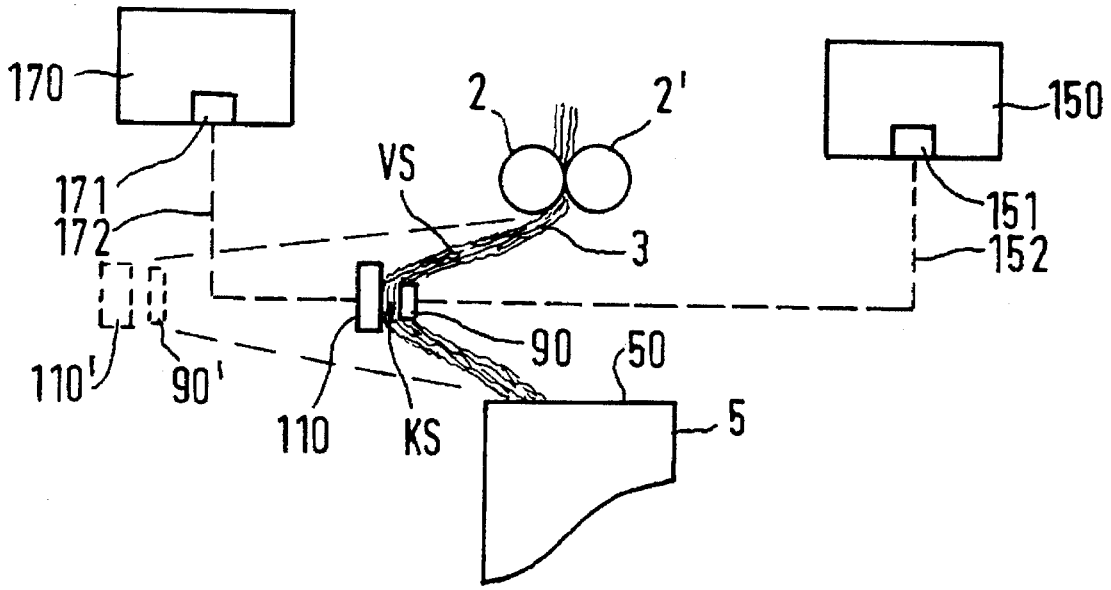
FIG. 3*c* shows position steps as the clamping device is displaced (side view of the sliver guiding channel)
Figure 3D:
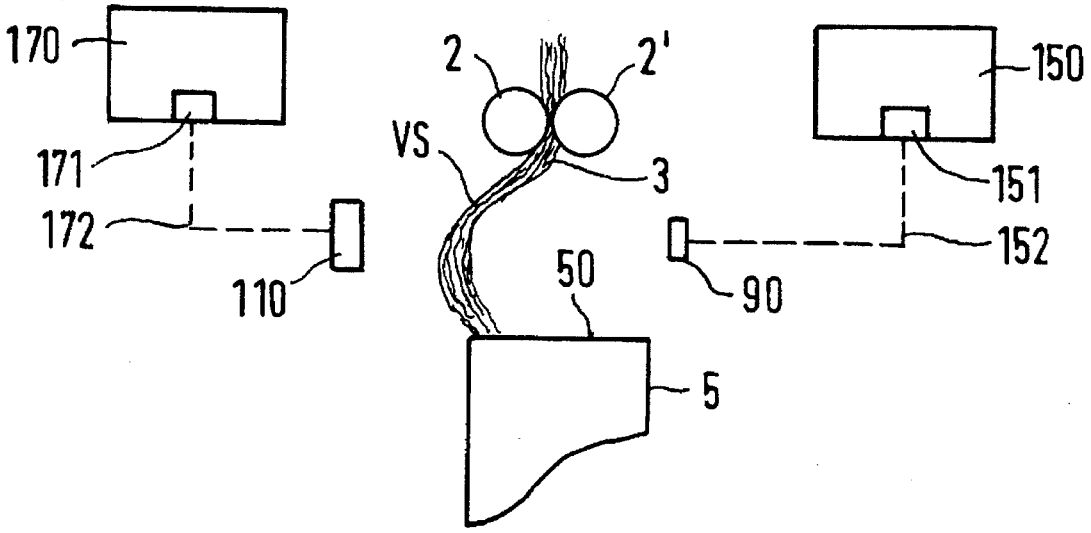
FIG. 3*d* shows the opening of the clamping device after formation of a drafting point and the deflected position of the fiber sliver.

FIGS. 3 to 3*d* document the operation of the severing device according to the invention. In order to bring out that which is essential, the drawings are simplified according to the above-mentioned figures. FIG. 3 shows a clamping lever 110 and a swivel arm 90 in their starting positions as the essential operational means. The two are placed across from each other in one plane, next to the sliver guiding channel 5. The inlet opening 50 of the sliver guiding channel 5 together with fiber sliver 3 from the schematic top view of said sliver guiding channel 5 are shown. The clamping lever 110 is connected to a displacement means 170. The displacement means 170 comprises a controlled drive 171 and a mechanical displacement mechanism 172 for the clamping lever 110. The swivel arm 90 is connected to a displacement device 150. The displacement device 150 comprises a controlled drive 151 and a mechanical displacement mechanism 152 for the swivel arm 90.

When the can 8 has reached its full state, as can be detected for example by a counting of sliver length at the draw frame, a can replacement and thereby severing of the fiber sliver become necessary. For the purpose of can replacement, the fiber sliver delivery, or at least the fiber sliver delivery of the pair of calendar rollers is briefly stopped on the draw frame for the duration of the severing process in order to carry out the can replacement. Starting form the basic position of the operating means according to FIG. 3, the swivel arm 90 is moved by the displacement means 150 at a right angle to the conveying direction of the fiber sliver. The movement of the swivel arm is towards the swivel lever 110 or its stop. The fiber sliver is held by the clamping lever 110 and by swivel arm 90 (FIG. 3*a*) and constitutes a clamping point KS.

As FIG. 3*b* furthermore shows, the clamping lever 10 and the swivel arm 90 are displaced together, in continuation of the direction of movement of the swivel arm 90, laterally to the conveying direction of the sliver. To facilitate understanding of the deflection of the sliver, FIG. 3*c* shows a side view looking towards the sliver guiding channel. The fiber sliver 3 is deflected laterally, as shown in FIG. 3*c*, away from the sliver guiding channel 5. The deflection of the fiber sliver 3 by the clamping lever 110 and the swivel arm 90 takes place to a sufficient extent so that a drafting of the fiber sliver occurs between the clamping point KS and the clamping point on the displacement path. This may be an adjustable end position of the clamping device on the displacement path. If this is the case, the adjusting devices 170 and 150 release the clamping as shown in FIG. 3. In this case, the fiber sliver 3 has a drafting point VS which is the same as the subsequent severing point TS. The displacement means 80 is now actuated and the can is displaced. The deflected fiber sliver is brought into the conveying direction through the displacement of the can. As the full can 8 is further displaced due to the can replacement, the fiber sliver is severed at a defined drafting point.

Another adjustable end position (broken line) is shown in FIG. 3*c*. The lateral deflection of the clamping lever 110 and the swivel arm 90 continues up to a position of clamping lever 110' and swivel arm 90'. In this adjustable position on the displacement path drafting continues until severing is carried out. This represents another alternative of the severing process.

Figure 4:
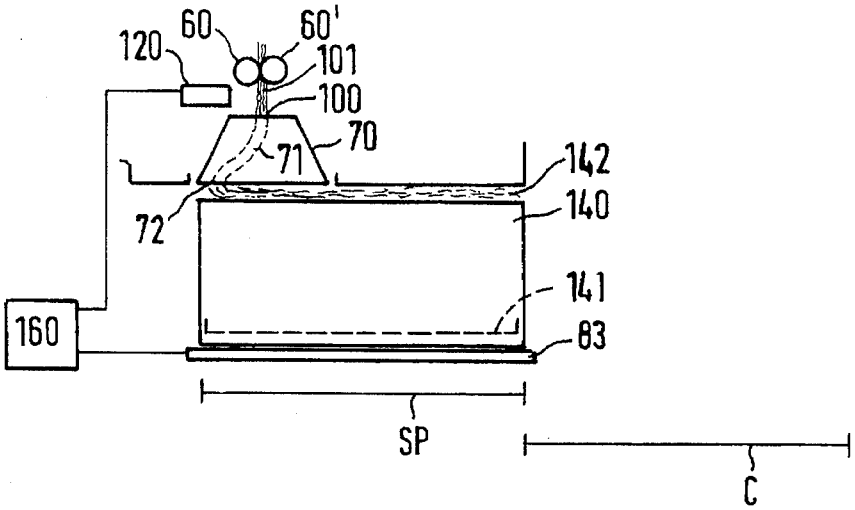
FIG. 4 shows the displacement of the flat can from its stopped position.
Figure 4A:
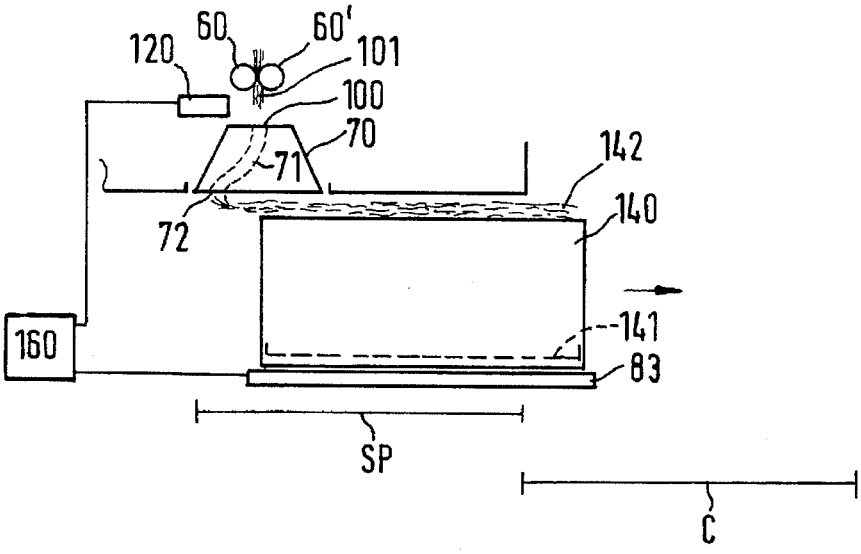
FIG. 4*a* shows the flat can in its transfer position.
Figure 4B:
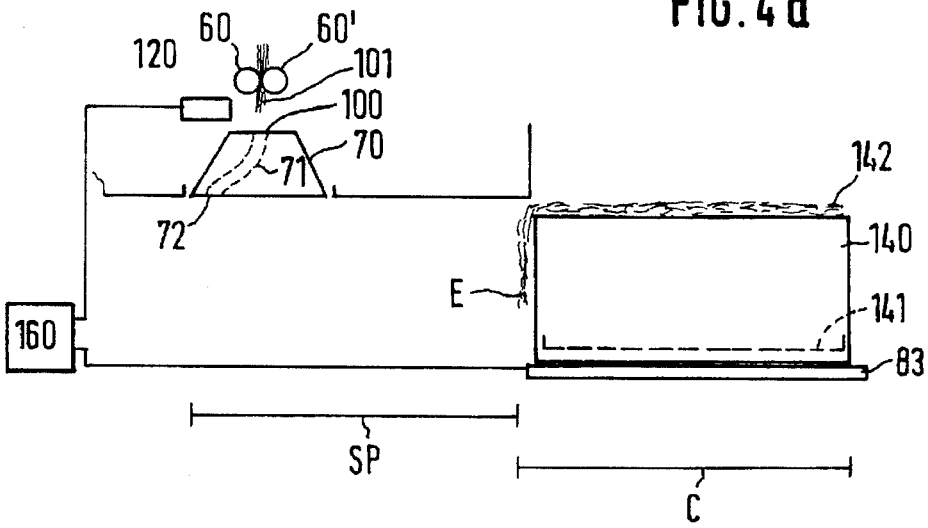
FIG. 4*b* shows the position of the sliver end.

FIGS. 4 to 4*b* show the severing device in connection with a flat can. FIG. 4 shows the flat can 140 in its stopped position SP. The flat can 140 has a movable can bottom 141 which is pressed downward. This indicates to the person schooled in the art that the can is full. The can mushroom 142 pushes the fiber sliver against the rotary plate 70 and the machine table. The rotary plate 70 is provided with a sliver guiding channel 71 with an opening 100 and an outlet 72. When the calendar rollers 60, 60' are stopped, the fiber sliver 101 protrudes from the calendar rollers, through the rotary plate 70 and towards the flat can 140. A clamping device 120 is placed between the pair of calendar rollers 60, 60' and the opening 100 of the sliver guiding channel 71. The clamping device is connected via an active connection to controls 160. These controls are also connected to the displacement means 83.

FIG. 4*a* shows that the clamping device 120 has already worked, i.e. has already formed a drafting point in the fiber sliver. In the picture it is significant that the can 140 is being displaced away from the stopped position SP by means of the displacement means 83. The displacement means may be a traversing device and/or a conveyor for flat cans. The displacement means 83 displaces the flat can 140 according to FIG. 4*b* into a transfer position C. It can be seen here that the sliver end was pulled out of the sliver guiding channel 71 of the rotary plate 70, whereby the drafting point was severed. The fiber sliver E hangs down from the forward wall of the flat can 140. If the rotary plate 70 with its outlet 72 was positioned in the longitudinal axis of the flat can for example, the fiber sliver E is deposited in the central area of the forward wall of the can. This is advantageous for the subsequent automating solutions concerning the conveying of the can and the piecing of the fiber sliver end on the machines for further processing. The fact that the sliver end E always hangs down in a defined length from the flat can is another advantage.

It will be apparent to those skilled in the art that various modifications and variations can be made in the present invention without departing from the scope and spirit of the invention. For example, features illustrated or described as part of one embodiment can be used in another embodiment to yield a still further embodiment. It is intended that the present invention cover such modifications and variations as come within the scope of the appended claims and their equivalents.

We claim:

1. A process for severing a fiber sliver on a textile machine which delivers a fiber sliver by a pair of calendar rollers through a sliver guiding channel defined in a rotary plate into a sliver can disposed below the rotary plate, said process comprising the steps of:

conveying the fiber sliver by the pair of calendar rollers into the sliver guiding channel defined in the rotary plate and into the sliver can disposed below the rotary plate;

stopping said conveying of the fiber sliver by the calendar rollers;

clamping the fiber sliver with a clamping device between the calendar rollers and the rotary plate so that the fiber sliver is clamped between the calendar rollers and the clamping device;

defining a drafted severing point in the fiber sliver between the calendar rollers and clamping device by displacing the clamping device relative to the calendar rollers; and severing the fiber sliver at the drafted severing point.

2. The process as in claim 1, comprising clamping the sliver with the clamping device at a distance below the nip of the pair of calendar rollers that is at least greater than the staple length of fibers in the fiber sliver, displacing the clamping device a predetermined distance along a displacement path so that the sliver has been drafted between the clamping device and pair of calendar rollers.

3. The process as in claim 2, comprising displacing the clamping device at a right angle to the conveying direction of the fiber sliver.

4. The process as in claim 2, comprising displacing the clamping device in a direction towards the sliver guiding channel.

5. The process as in claim 1, comprising severing the sliver at the severing point by displacing the sliver can from below the rotary plate.

6. The process as in claim 1, comprising severing the sliver at the severing point by clamping the sliver with the clamping device and displacing the clamping device sufficiently far along a displacement path until the sliver severs.

7. A textile machine having a device for severing a fiber sliver delivered by the textile machine, said machine comprising:

a pair of calendar rollers configured for conveying a fiber sliver therebetween;

a rotary plate having a sliver guiding channel defined therethrough, said rotary plate operably disposed downstream from said calendar rollers for delivering the sliver into a can disposed below said rotary plate;

a displaceable clamping device operably disposed between said calendar rollers and said rotary plate, said clamping device displaceable along a displacement path defined relative to a conveying direction of the fiber sliver, said clamping device configured to grasp the sliver at a position between said calendar rollers and said sliver guiding channel whereby subsequent displacement of said clamping device along said displacement path drafts the sliver thereby defining a severing point at the drafted portion of the sliver;

a can displacement device moving the can from below said rotary plate once the sliver has been drafted thereby severing the sliver at the drafted severing point on the sliver; and a control circuit configured with said clamping device and said displacement device controlling movement thereof to cause the sliver to be drafted and subsequently severed at the drafted portion of the sliver.

8. The machine as in claim 7, wherein said clamping device is disposed adjacent to the conveying path of the sliver between said calendar rollers and said sliver guiding channel.

9. The machine as in claim 7, wherein said displacement path of said clamping device is essentially at a right angle to the conveying direction of the sliver between said calendar rollers and said sliver guiding channel.

10. The machine as in claim 7, wherein said displacement path of said clamping device is essentially along the conveying direction of the sliver between said calendar rollers and said sliver guiding channel.

11. The machine as in claim 7, wherein said clamping device is movable to a plurality of fixed positions along said displacement path thereby causing variable degrees of drafting of the sliver.

12. The machine as in claim 7, wherein said clamping device comprises a clamping lever having a stop defined therein and a swivel arm forming a clamping point with said stop, said clamping lever and said swivel arm connected to controllable displacement mechanisms such that said swivel arm is movable towards said clamping lever to grasp the sliver against said stop, and said swivel arm and said clamping lever are subsequently moveable together along said displacement path.

13. The machine as in claim 12, wherein said displacement mechanisms comprise controllable drives connected to displacement members.

14. The machine as in claim 12, wherein said swivel arm comprises a drive arm connected at an angle thereto, said swivel arm and drive arm rotatably mounted at their zenith to a rotary axle, said clamping lever mounted at one end thereof to said rotary axle.

15. The machine as in claim 14, further comprising a displacement member rotatably connected to said drive arm via an axle, wherein displacement of said displacement member causes said drive arm and swivel arm to swivel relative to said rotary axle.

16. The machine as in claim 15, further comprising a displacement member rotatably connected to said clamping lever via an axle, wherein displacement of clamping lever displacement member causes said clamping lever to swivel relative said rotary axle.

17. The machine as in claim 15, further comprising an adjusting oblong hole defined in said drive arm, said axle variably positionable within said oblong hole.

18. The machine as in claim 12, wherein said swivel arm and said clamping lever are displaceable in a direction at a right angle to the conveying direction of the fiber sliver.

* * * * *